US005704068A

United States Patent [19]

Martin

[11] Patent Number: 5,704,068

[45] Date of Patent: Jan. 6, 1998

[54] COLD WEATHER COWL

[76] Inventor: Lee Martin, 10819 Spur Highway #233, Kenai, Ak. 99611

[21] Appl. No.: 705,320

[22] Filed: Aug. 29, 1996

[51] Int. Cl.[6] ..... A42B 1/00; A42B 1/06

[52] U.S. Cl. ..... 2/173; 2/206; 2/202; 2/175.6; 128/201.13; 128/201.17; 128/201.24

[58] Field of Search ..... 2/84, 93, 108, 2/172, 173, 202, 203, 206, 207, 209, 175.6, 424, 94; 128/201.13, 201.17, 201.24, 201.25, 206.17, 206.16

[56] References Cited

U.S. PATENT DOCUMENTS

| | | | |
|---|---|---|---|
| 772,148 | 10/1904 | Hughes | 2/206 |
| 787,167 | 4/1905 | Gates | 128/206.16 |
| 1,251,657 | 1/1918 | Hart | 2/10 X |
| 1,525,030 | 2/1925 | Galanis | 2/173 |
| 2,839,757 | 6/1958 | Gianola | 2/173 |
| 3,768,100 | 10/1973 | Colman et al. . | |
| 4,032,991 | 7/1977 | Vandeweghe | 128/201.25 |
| 4,180,868 | 1/1980 | Snow | 2/203 |
| 4,520,509 | 6/1985 | Ward . | |
| 4,573,217 | 3/1986 | Reed | 2/202 |
| 4,641,379 | 2/1987 | Martin . | |
| 4,832,018 | 5/1989 | Pantaleon-Stemberg | 128/206.17 |
| 4,941,211 | 7/1990 | Blutstein . | |
| 4,961,232 | 10/1990 | Hulsey . | |
| 5,007,114 | 4/1991 | Numano | 128/201.13 |
| 5,025,507 | 6/1991 | Kirby . | |
| 5,035,006 | 7/1991 | Hetz et al. . | |
| 5,058,211 | 10/1991 | Hanks | 128/201.13 |
| 5,119,808 | 6/1992 | Marquardt et al. | 128/201.24 |
| 5,214,804 | 6/1993 | Carey et al. . | |
| 5,251,336 | 10/1993 | Nevins . | |
| 5,575,009 | 11/1996 | Ryvin | 2/173 |
| 5,628,308 | 5/1997 | Harges, Jr. et al. | 128/201.25 |

FOREIGN PATENT DOCUMENTS

| | | | |
|---|---|---|---|
| 1112408 | 8/1961 | Germany | 128/206.16 |

*Primary Examiner*—Jeanette E. Chapman
*Attorney, Agent, or Firm*—Haugen and Nikolai, P.A.

[57] ABSTRACT

A cowl to protect the head, face and neck of an individual from the cold is disclosed. The cowl includes a skull cap, ear band, neck drape and face mask. The face mask includes a breathing channel design to cause air exhaled by the individual to travel down and away from the nose and eyes to reduce the likelihood that glasses or goggles also worn by the individual will become fogged by the exhaled air.

14 Claims, 4 Drawing Sheets

COLD WEATHER COWL

BACKGROUND OF THE INVENTION

I. Field of the Invention

The present invention relates to cold weather clothing. More particularly, the present invention relates to a cowl which is designed to protect the head, face and neck of an individual from the cold. The cowl includes a skull cap, ear band, neck drape and face mask. The face mask includes a breathing channel so that air exhaled by the individual wearing the cowl travels down and away from the nose and eyes. This serves to reduce the likelihood that glasses or goggles also being worn by the individual will become fogged by the exhaled air.

II. Background of the Invention

From the time humans first inhabited the earth there has been a need for clothing to protect them from the elements. This has been particularly true in cold climates where the human body is readily susceptible to frost bite, hypothermia or even death as a result of the cold. Even in modern times the need for cold weather gear exists. The need to work in inclement weather, and the desire to engage in recreational activities such as snowmobiling, skiing, ice skating, fishing, and hunting on even the coldest of days creates the need for garments which will protect the body from the elements.

Various types of protective garments have been developed throughout recorded history. Insulating and protective boots, socks, pants, coats, gloves, mittens, and hats have all been used for centuries. However, even the highest quality garments often fail to provide sufficient protection during severely cold weather. Many cold weather garments also inhibit free motion of the wearer, which is disadvantageous particularly when the wearer is trying to engage in productive work in the cold. Many cold weather garments developed to date also preclude free circulation of air and thus obstruct breathing. Finally, when such garments are worn in combination with glasses or goggles, the glasses or goggles can quickly become fogged, restricting the visibility of the wearer.

In view of the forgoing, a principal object of the present invention is to provide cold weather headgear which encapsulates the head and provides warmth and protection from the cold.

Another object of the invention is to provide cold weather headgear allowing a free range of motion by the wearer.

Still another object of the invention is to provide cold weather head gear which will not obstruct the breathing of the wearer.

A further object of the invention is to provide cold weather headgear which can be worn with eye glasses and goggles.

An additional object of the invention is to provide cold weather head gear which inhibits the wearer's breath from fogging glasses or goggles worn by the wearer with the head gear.

Still another object of the present invention is to provide cold weather headgear made out of a material which does accumulate frost and which permits any frost which is accumulated to be easily brushed away.

SUMMARY OF THE INVENTION

In view of the forgoing objectives, the present invention is directed to providing a cowl which protects the wearer's head, neck and face while working or recreating in cold weather environments. The preferred embodiment of the cowl includes a skull cap, ear band, neck drape, and face mask. The skull cap is designed to protect the top of the wearer's head. The ear band surrounds the forehead, ears and back of the wearer's head. The neck drape extends downwardly from the ear band and is designed so that it can be tucked into the wearer's coat to provide a seal between the coat and the cowl and adequately protect the neck from the cold. The face mask is stitched to the cowl. The face mask has a center section and a pair of outer sections. The outer sections are designed to be releasably attached to the ear band. The center section of the face mask includes an inner member and an outer member. The inner member is made of neoprene so that frost will not accumulate on the inner member. The inner member also has a nose hole and a mouth hole to permit one to breathe. The outer member cooperates with the inner member to provide a breathing channel. The breathing channel is closed at the top and open at the bottom. Thus, air exhaled by the wearer passes through the nose and/or mouth holes into the breathing channel where it is directed downwardly and outwardly away from the nose and eyes of the wearer so that goggles or glasses worn in combination with the cowl do not become fogged. Finally, the cowl includes flexible sealing bands to provide a tight seal between the openings in the cowl and the face. The sealing bands prevent wind and cold air from entering between the cowl and the wearer's head.

Further information related to the preferred embodiments of the invention and the advantages such embodiments provide to the wearer will become apparent to those skilled in the art upon consideration of the accompanying specification, claims and drawings.

DETAILED DESCRIPTION OF THE PREFERRED EMBODIMENT

Figure 1:
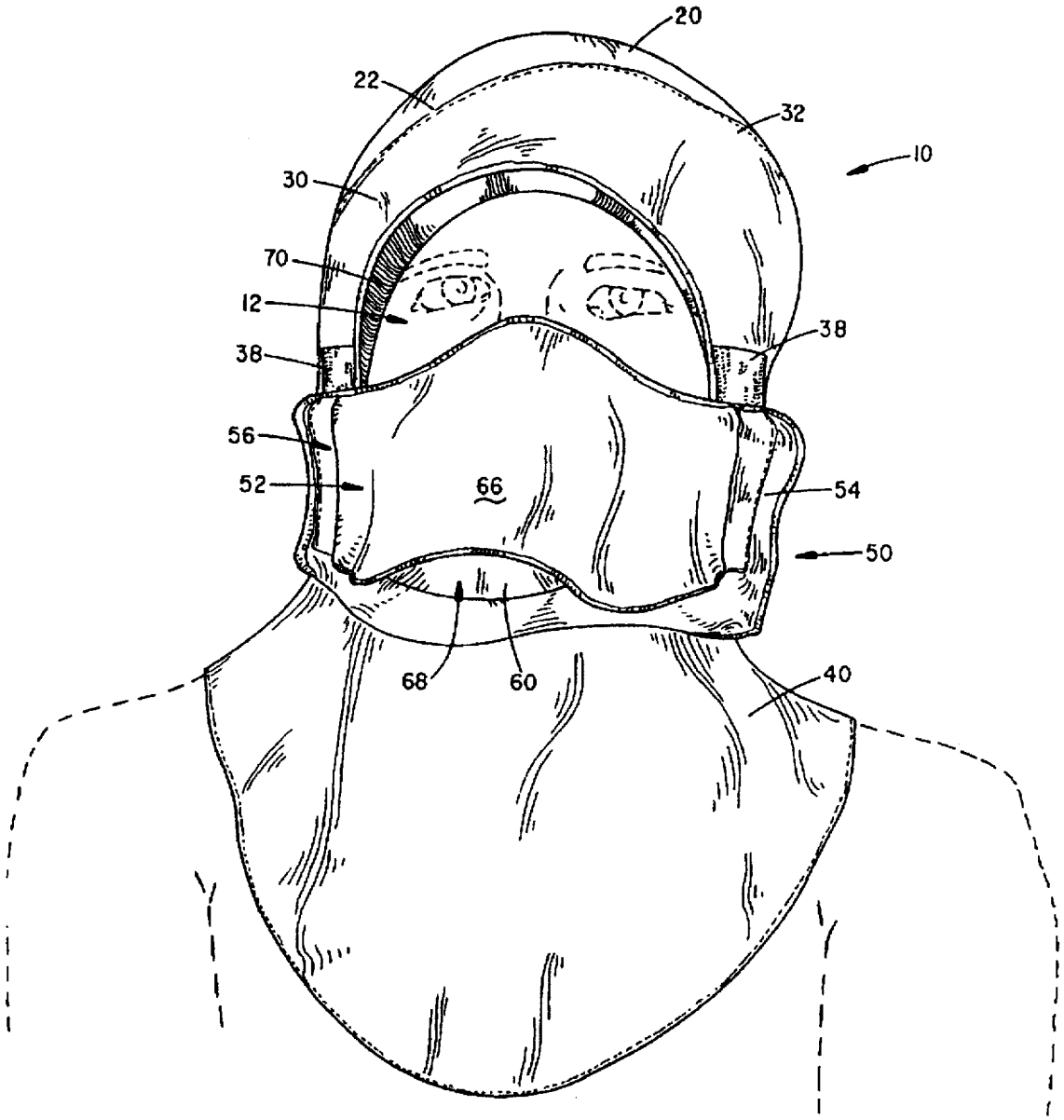
FIG. 1 is a perspective view of the cowl of my invention.

As shown in FIG. 1, the cowl 10 of the present invention includes a skull cap 20, ear band 30, neck drape 40, and face mask 50. The skull cap 20 is designed to cover and protect the top of the wearer's head. The base 22 of the skull cap 20 is, in the preferred embodiment, stitched or otherwise attached to the top 32 of the ear band 30.

The ear band 30 is designed to surround and protect the forehead, ears, and back of the wearer's head. In the preferred embodiment, the base 34 of the ear band is stitched or otherwise attached to the top 42 of the neck drape 40. As shown in the drawings, the stitching between the base 34 of the ear band 30 and top 42 of the neck drape 40 begins just below the ears and extends around the back of the neck. With this arrangement, a face opening 12 is provided between the ear band 30 and the neck drape 40.

Figure 2:
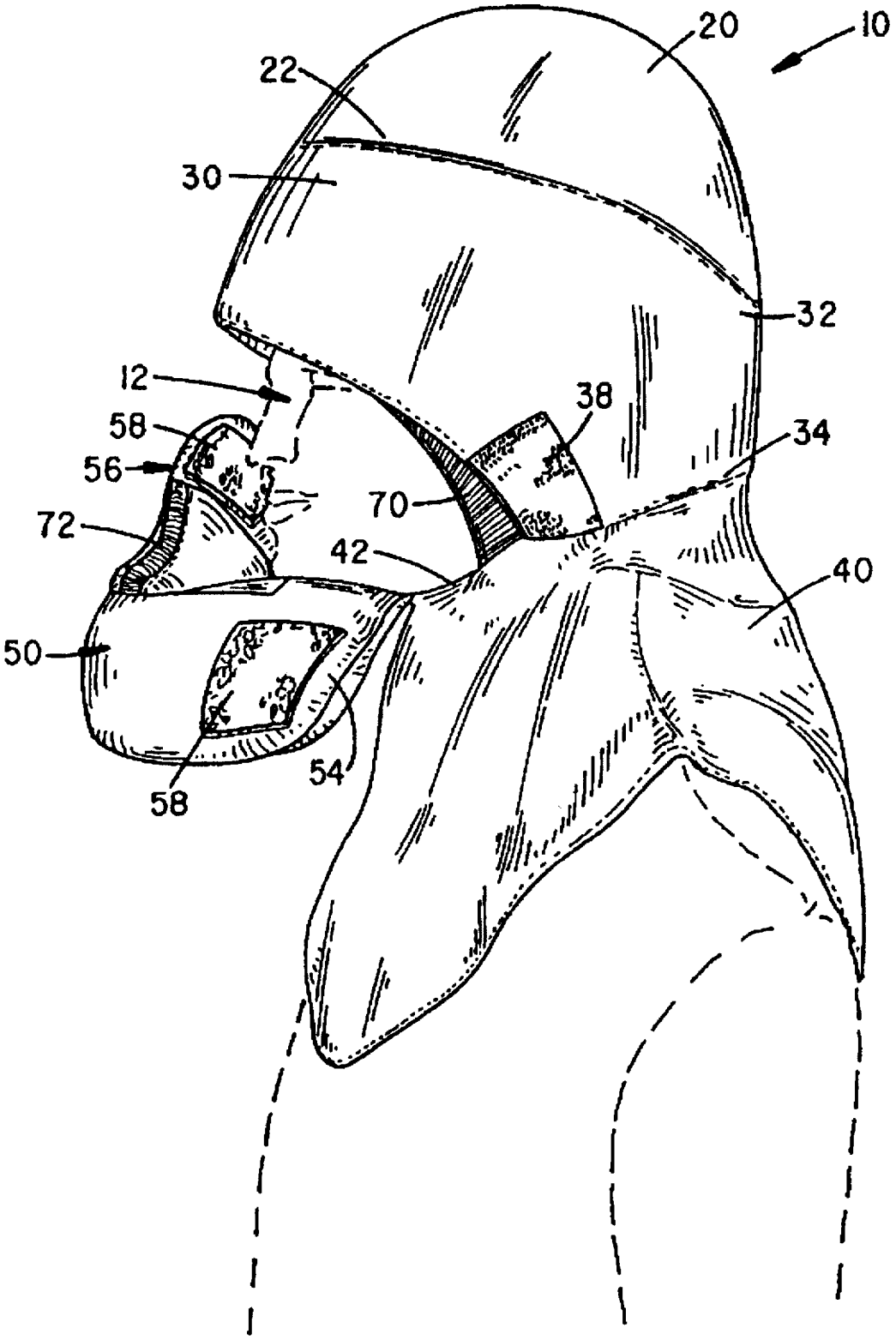
FIGS. 2 is a side view of the cowl of the present invention positioned on a user shown in phantom with the face mask in the down position.
Figure 3:
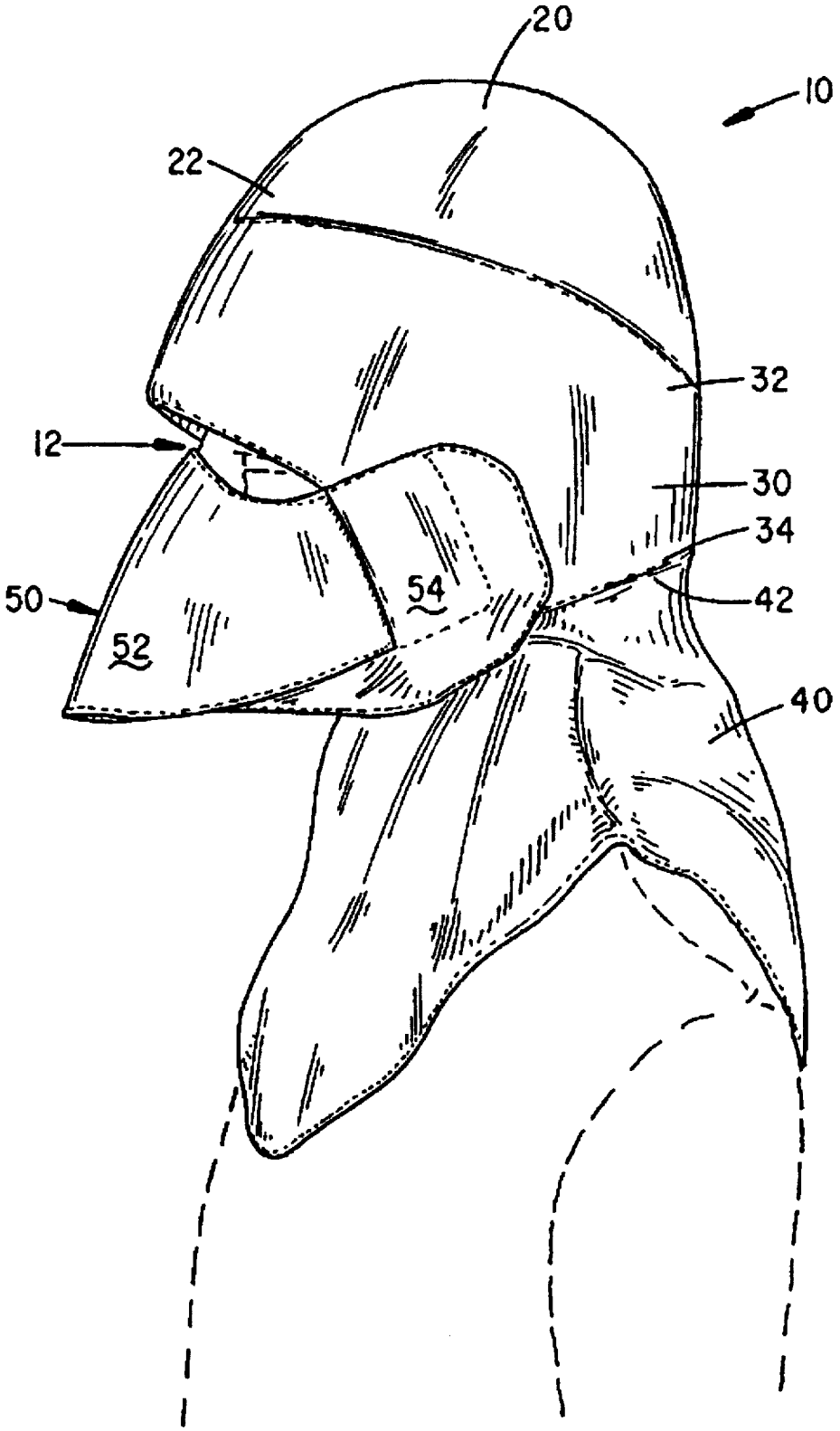
FIG. 3 is a side view of the cowl of the present invention positioned on a user shown in phantom with the face mask in the up position.
Figure 4:
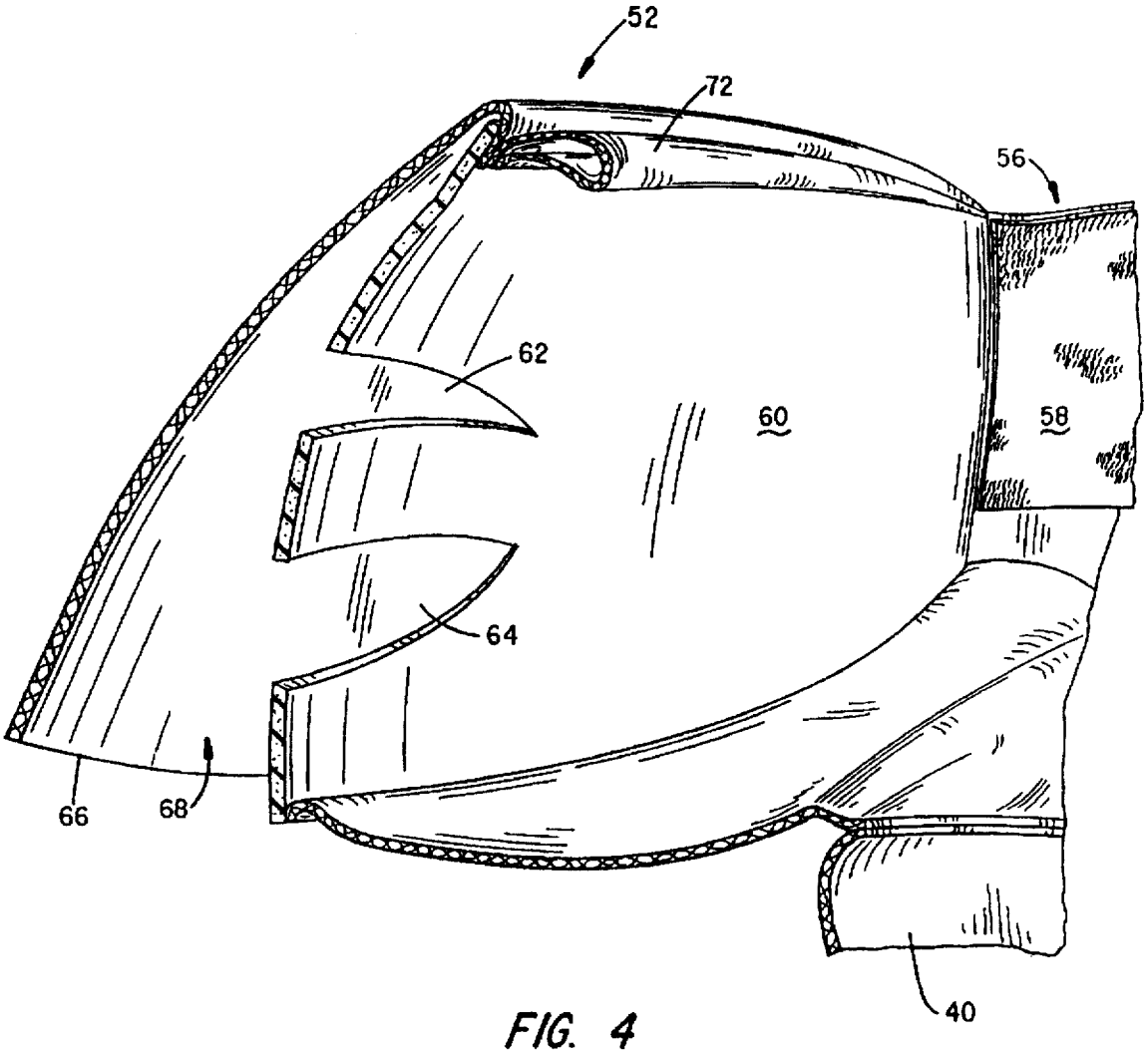
FIG. 4 is a cross-section of the face mask of the cowl.

Stitched to the neck drape 40 at the bottom of the face opening 12 is the face mask 50. As shown in FIGS. 2 and 3, the face mask 50 is designed so that it can be pulled away from the face or can be secured in an up position to protect the nose, mouth, chin and cheeks of the face from the cold weather. The face mask 50 has a center section 52 and a pair of outer sections 54 and 56. Each of the outer sections 54 and 56 have a pad 58 which cooperates with a pad 38 on the ear band 30 to provide a hook and loop type closure. The pads which form this hook and loop type closure are sold by Velcro Industries under the registered trademark "Velcro". The hook and loop type closures formed by the pads 38 and 58 are used to adjustably and releasably secure the face mask 50 in the up position so that the face mask 50 can protect the nose, mouth, cheeks and chin of the wearer.

An important feature of the cowl 10 of the present invention is the design of the center section 52 of the face mask 50. The center section 52 has an inner member 60. The inner member 60, in the preferred embodiment, has a nose hole 62 and a mouth hole 64 to permit the wearer to breathe and talk. The inner member 60 is preferably made of a material such as neoprene. The advantage of using such a material is that frost will not accumulate on the inner member. If frost does accumulate it can be brushed away. Those skilled in the art will recognize that other synthetic and natural fabrics having similar properties may also be used without deviating from the invention.

The center section 52 of the face mask 50 also includes an outer member 66. The outer member 66 is stitched to the inner member 60 at the respective tops and sides of the inner member 60 and outer member 66. However, the bottom of the outer member 66 and inner member 60 are not stitched. Given this arrangement, a breathing channel 68 is formed between the inner member 60 and the outer member 66. This breathing channel 68 serves to direct air exhaled by the wearer down and away from the nose and eyes so that goggles or glasses being worn in conjunction with the cowl 10 do not become fogged. To keep the breathin channel 68 open, one or more stays (not shown) made of neoprene or any other suitable material might be used in conjunction with the outer member 66.

To provide a tight seal between the wearer's skin and the cowl 10 around the face opening 12, a band 70 of stretch nylon or a material having similar properties can be sown to the neck drape 40 and ear band 30 in the area of the opening. Likewise, another band 72 can be shown to the top of the face mask 50 to ensure a tight seal. Alternatively, some other form-fitting material can be used to create a tight seal across the bridge of the nose and under the eyes.

When in use, the cowl 10 of the present invention is pulled over the wearer's head and aligned so that the face is centered in the opening 12. The neck drape 40 is designed to be tucked in to the neck opening of the wearer's coat to provide a seal between the coat and the cowl 10 so that cold air does not penetrate in the area of the neck. The wearer then positions the face mask 50 in the up position using the adjustable closures formed by the pads 38 and 58 to hold the face mask 50 in place. While the closure shown in the preferred embodiment is made up of the pads 58 and 38, other closures such as snaps or straps may also be used. The advantage of the closure arrangement shown in the drawings is that it is adjustable so that various users can pull the face mask 50 into position and secure it in such a way that a tight seal is provided between the top of the face mask 50 and the wearer's face.

Those skilled in the art will understand that a variety of fabrics can be used in constructing the skull cap 20, ear band 30, neck drape 40 and face mask 50. Important characteristics of the material selected include the desire that it be soft to the touch, well insulating, durable, and attractive. One such material particularly well suited for the present invention is sold by Polartek under their designation Windblock-Series 2000. Such a material can be used alone or in combination with other materials to provide a warm, durable, well fitting cowl. Alternatively, the cowl can be made of a laminate having an inner surface consisting of Polartek's Windblock-Series 2000 material and an exterior surface consisting of neoprene. Other combinations of materials may also be used.

Clearly, numerous changes may be made to the preferred embodiment. For example different combinations of materials may be used to achieve beneficial results. Different arrangements for releasably securing the face mask to the ear band may also be used. Cowls lacking certain of the components described above could also be constructed and still follow the teachings of the present invention. For example, the skull cap could be replaced by a separate cap or the neck drape could be replaced by a separate scarf.

Having illustrated and described the principles of the invention with respect to the preferred embodiment, it should be apparent to those skilled in the art that the invention may be modified in arrangement and detail without departing from such principles. It is, therefore, intended that any and all such modifications be covered by the following claims.

We claim:

1. A cold weather cowl which can be worn in combination with eyewear to protect the wearer from the cold, said cowl including:

(a) an ear band;

(b) a face mask having a center section and a pair of outer sections, said center section having an inner member and an outer member which are coupled together at their respective tops to form a breathing channel having a closed top and an open bottom, said inner member having at least one breathing opening into said breathing channel;

(c) means for adjustably securing the outer sections of said face mask to said ear band so that the center section of said face mask covers the nose and mouth of the wearer such that air exhaled by the wearer passes through said breathing opening into said breathing channel where it is directed down and away from the wearer's eyes.

2. A cold weather cowl to protect the head and face of the wearer, said cold weather cowl including (a) a skull cap;

(b) an ear band attached to said skull cap;

(c) a face mask having a center section and a pair of outer sections, said center section having an inner member and an outer member which are joined at their respective tops to form a breathing channel which is closed at the top and open at the bottom, said inner member having at least one breathing opening into said breathing channel;

(d) means for adjustably securing the outer sections of said face mask to said ear band so that the center section of said face mask covers the nose and mouth of the wearer such that air exhaled by the wearer passes through said breathing opening into said breathing channel where it is directed down and away from the wearer's eyes.

3. A cold weather cowl to protect the head, face and neck of the wearer, said cold weather cowl including:

(a) an ear band;

(b) a neck drape attached to and extending downwardly from said ear band;

(c) a face mask attached to said neck drape, said face mask having an inner member and an outer member, said inner member having at least one breathing opening, said outer member covering the inner member, being closed at the top with said inner member and being open at the bottom to form a breathing channel between the inner and outer members which serves to direct exhaled air down and away from the wearer's nose and eyes; and (d) means for releasable securing said face mask to said ear band.

4. The cold weather cowl of claim 3 further including a skull cap, attached to the ear band, for covering the top of the wearer's head.

5. The cold weather cowl of claim 3 further including a first sealing band attached to the ear band and neck drape to surround a first portion of the wearer's face to seal the cowl to said first portion of the face to protect against wind penetrating between the cowl and said first portions of the wearer's face.

6. The cold weather cowl of claim 5 further including a second sealing band attached to the top of the face mask to seal the top of the face mask to a second portion of the wearer's face to protect against wind penetrating between the top of the face mask and said second portion of the wearer's face.

7. The cold weather cowl of claim 6 wherein said first and second sealing bands are made of stretch nylon.

8. The cold weather cowl of claim 3 wherein the inner member of said face mask is made of neoprene.

9. The cold weather cowl of claim 3 wherein the inner member of said face mask has two breathing openings, one for the wearer's nose and one for the wearer's mouth.

10. The cold weather cowl of claim 3 wherein said means for releasably securing said face mask to said ear band are first and second hook and loop type closures.

11. The cold weather cowl of claim 8 wherein said ear band, neck drape, and outer member of said face mask are all made out of insulating material which is soft to the touch.

12. The cold weather cowl of claim 4 wherein said skull cap, ear band, neck drape and outer member of said face mask are all made out of insulating material which is soft to the touch and said inner member of said face mask is made of neoprene.

13. The cold weather cowl of claim 4 wherein said skull cap, ear band, neck drape, and outer member of said face mask are all made of a laminate, the inner layer of said laminate being soft to the touch.

14. A cowl to protect the head, face and neck of the wearer from cold weather, said cowl including:

(a) a skull cap;

(b) an ear band attached to the skull cap;

(c) a neck drape attached to the ear band;

(d) a face mask attached to said neck drape, said face mask having a first up position in which it covers the nose, mouth and chin of the wearer and a second down position, said face mask having an inner member and an outer member each having respective tops, bottoms, and sides, said inner member having at least one breathing hole, said inner and outer members being coupled together at said respective tops and sides to form a breathing channel having a closed top, closed sides, and an open bottom for directing air exhaled by the wearer down and away from the wearer's nose and eyes;

(e) means for releasably holding said face mask in said position; and (f) means for sealing portions of the cowl to the face to inhibit wind from entering between the cowl and the face.

* * * * *